US005954419A

United States Patent [19]

D'Angelo

[11] Patent Number: 5,954,419

[45] Date of Patent: Sep. 21, 1999

[54] WINDOW LIGHT ASSEMBLY

[76] Inventor: Michael F. D'Angelo, 451 W. 37th St., Chicago, Ill. 60609

[21] Appl. No.: 08/988,664

[22] Filed: Dec. 11, 1997

[51] Int. Cl.[6] ..... F21V 21/00

[52] U.S. Cl. ..... 362/152; 362/249; 362/125; 362/806; 362/252

[58] Field of Search ..... 362/249, 125, 362/250, 806, 252, 145, 152

[56] References Cited

U.S. PATENT DOCUMENTS

| | | | |
|---|---|---|---|
| 4,244,014 | 1/1981 | Van Ess | 362/149 |
| 4,357,653 | 11/1982 | Kovacs | 362/250 |
| 4,821,158 | 4/1989 | Mitten | 362/249 |
| 4,852,832 | 8/1989 | Delaney | 362/806 |
| 5,510,966 | 4/1996 | Konecny | 362/145 |
| 5,628,557 | 5/1997 | Huang | 362/152 |
| 5,791,762 | 8/1998 | Wroblewski | 362/152 |

*Primary Examiner*—Thomas M. Sember
*Attorney, Agent, or Firm*—Mark E. Wiemelt

[57] ABSTRACT

A custom window light assembly for displaying ornamental lights within a window including a substantially rectangular plastic frame assembly which includes an elongated generally rectangular lower member, an elongated generally rectangular upper member disposed opposite the elongated rectangular lower member, and two opposed elongated rectangular side members. The upper member, lower member and side members have respective member ends which are joined together by plastic welding proximate the respective member ends forming generally right angles and defining a generally rectangular opening. The frame assembly is constructed and dimensioned to define an outer periphery adapted to nest within the inner periphery of a window frame. The upper member, lower member and opposed side members have respective inner facing surfaces defining a plurality of generally cylindrical chambers at regularly spaced intervals. The chambers extend through the entire width of the upper member, lower member and opposed side members and are sized to receive therein associated light sockets of a string of conventional ornamental lights. The upper member, lower member and opposed side members have respective outer surfaces defining grooves extending substantially the lengths thereof and being sized and disposed to receive therethrough the light sockets of a string of conventional ornamental lights and to receive and house the wiring for the lights. The grooves are covered with colored tape to conceal the wiring. The lower ends of the side members rest upon the window sill of the window providing resting support to said frame assembly.

12 Claims, 6 Drawing Sheets

WINDOW LIGHT ASSEMBLY

BACKGROUND OF THE INVENTION

The present invention relates generally to a new and improved window light assembly, and in particular to a window frame assembly having ornamental lights.

Numerous devices and procedures have heretofore been proposed for providing windows with ornamental and decorative Christmas lights. However, each of the prior art devices and procedures have been found wanting in one or more particulars. Specifically, the user of the prior art devices and procedures must generally manually affix strands of Christmas lights proximate the periphery of window frames or directly on the window panes. Each successive season the lights must be restrung, affixed and removed, such process resulting in a cumbersome, difficult, laborious and time-consuming process. Thus the user of the prior art devices is not able to continuously, rapidly, easily and efficiently string lights. In addition, the lights are generally positioned on the exterior of the building where they and the installer are subject to environmental conditions and where they can be seen only from the exterior of the building.

The invention of this application represents a recent innovation in the art which overcomes the deficiencies of the prior art by providing a window light assembly which includes lights and which is easily installed on the interior of the building to allow viewing from the interior and exterior of the building.

SUMMARY OF THE INVENTION

It is an important object of the present invention to provide an improved window light assembly adapted to display ornamental lights.

It is another object of the present invention to provide an improved window light assembly adapted to display ornamental lights which can be customized to fit specific window sizes and shapes.

It is a further object of the invention to provide a window light assembly adapted to display ornamental lights which can be efficiently manufactured with regard to apparatus materials and labor, and can be easily marketed to the buying public at low sale prices.

It is another object of the present invention to provide a window light assembly adapted to display ornamental lights that is easily utilized and advantageous to a user.

It is further object of the present invention to provide a window light assembly adapted to display ornamental lights which may be used year after year.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention. The various features of novelty which characterize the invention are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated preferred embodiments of the invention.

A broad aspect of the invention involves an improved window light assembly. The window light assembly is provided for the purpose of displaying ornamental lights within a window. The window light assembly includes a frame assembly which is substantially rectangular in shape and is dimensioned to fit the opening in a window frame. Upper member, lower member and opposed side members are constructed of plastic and cooperatively engaged proximate their respective member ends forming right angles and defining a rectangular opening. Lower ends of the opposed side members of the preferred embodiment project a distance beyond the lower member. The upper member, lower member, and opposed side members are independently formed and joined together by plastic welding. The frame assembly is constructed of plastic.

The outer periphery of the frame assembly is constructed and dimensioned to nest within the inner periphery of a window frame and is secured thereto by a single nail driven through the upper member into the top of the window frame and engaging the upper member and the window frame. The lower ends of the opposed side members which extend beyond the lower member are dimensioned to rest upon the window sill providing resting support to the frame assembly.

Formed within the inner facing surfaces of the upper member, lower member and opposed side members at regularly spaced intervals are a plurality of generally cylindrical chambers extending through the entire width of the upper member, lower member and opposed side members. The chambers are sized to receive therein in frictional engagement associated light sockets of a string of conventional ornamental lights. The sockets may be glued within the chambers.

Formed within the outer surfaces of the upper member, lower member and opposed side members are generally rectangular grooves extending substantially the lengths thereof and being sized and disposed to receive therethrough the light sockets of a string of conventional ornamental lights and to receive and house the wiring for the lights. The grooves are covered with colored tape to conceal the wiring.

In operation, the window frame assembly is premeasured, sized and constructed to fit a window. The wiring of a string of conventional lights is disposed in the grooves with the light sockets being fed into securing engagement within associated chambers. The light sockets then receive and seat first ends of associated light bulbs which are fed through the inner facing surfaces of the upper member, lower member and opposed side members, the opposite ends of the light bulbs projecting laterally inwardly from the frame assembly. The tape is then disposed along the outer periphery of the frame assembly to conceal the wiring. The frame assembly is nested within the window frame in the interior of a building proximate the window pane and secured by a nail driven through the upper member into the top of the window frame.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
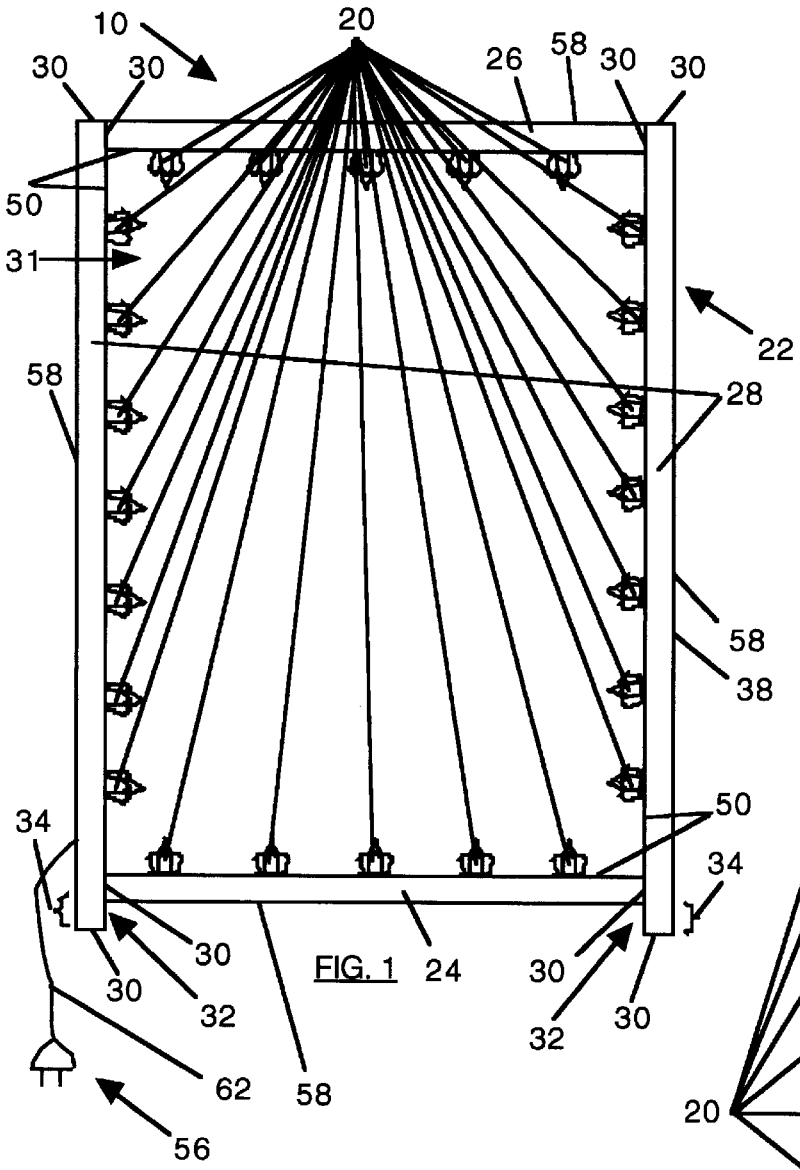
FIG. 1 is a front elevational view of a preferred form of the window light assembly constructed according to the principles of the present invention.
Figure 2:
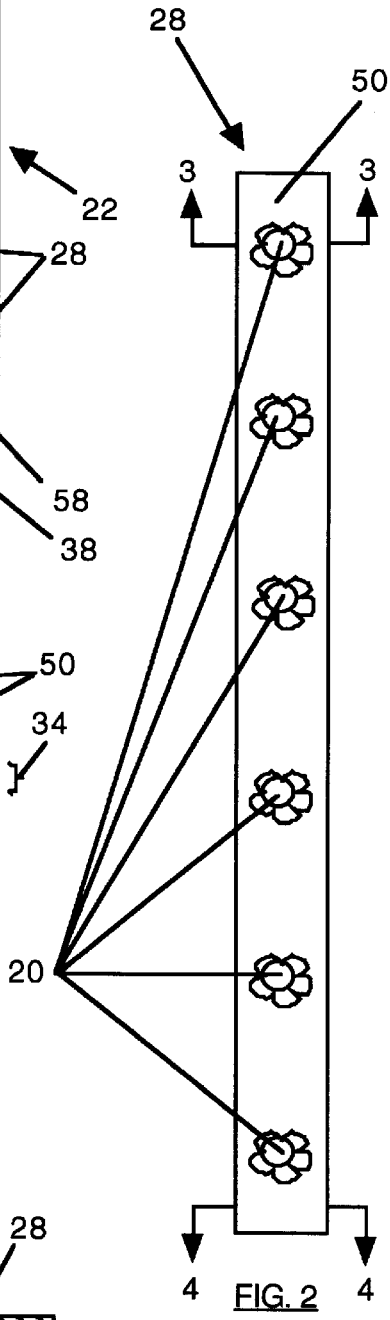
FIG. 2 is a side elevational view of a side member illustrating the spaced arrangement of the ornamental lights along the length of the side member.
Figure 3:
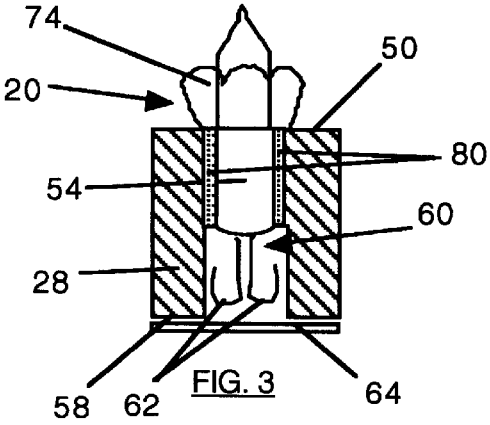
FIG. 3 is a taken along line 3—3 of FIG. 2 illustrating the light, groove, chamber, glue and tape of the preferred form of the window light assembly, and the cooperation thereamong.
Figure 4:
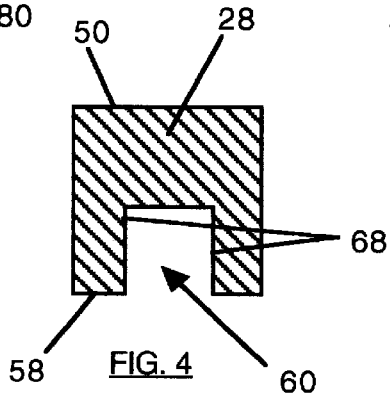
FIG. 4 is a view taken along line 4—4 of FIG. 2, illustrating the construction of the groove.
Figure 5:
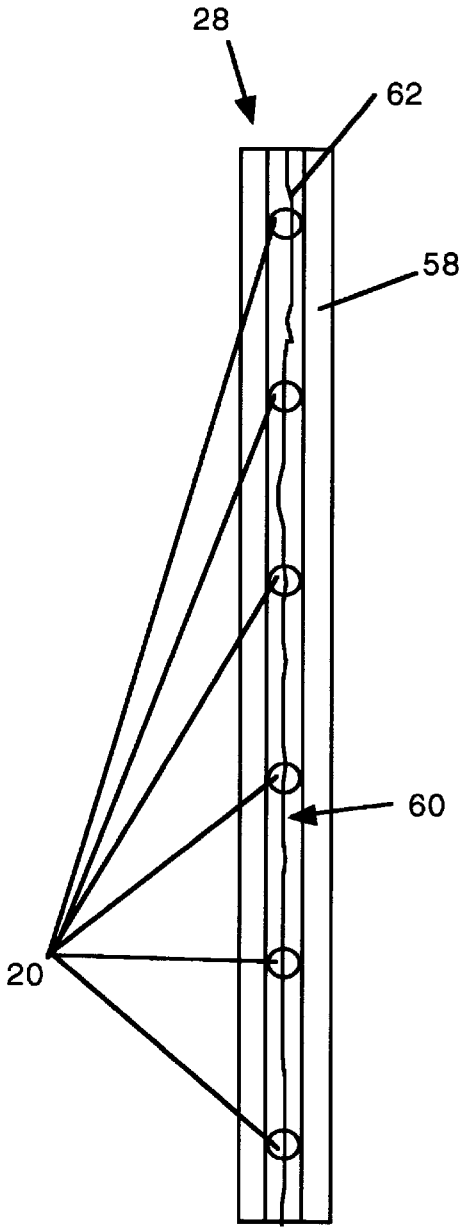
FIG. 5 is a side view elevational view of a side member illustrating the spaced arrangement of the ornamental lights along the length of the side member and the wires within the groove.
Figure 6:
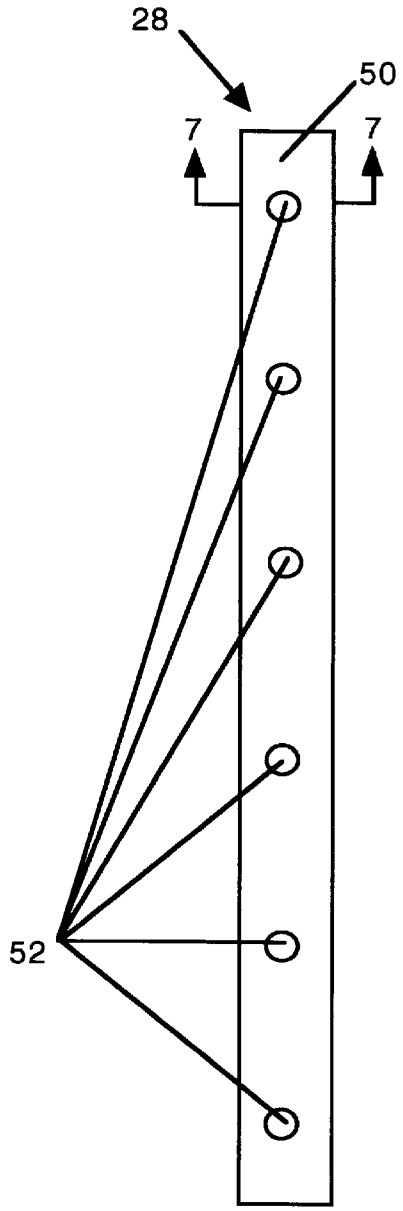
FIG. 6 is a side elevational view of a side member of the window light assembly constructed according to the principles of the present invention, illustrating the chambers spaced along the length thereof.
Figure 7:
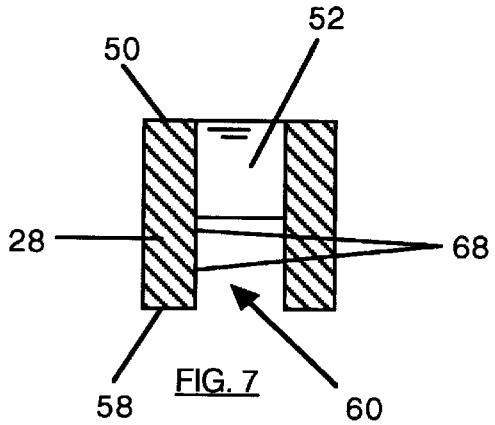
FIG. 7 is a view taken along line 7—7 of FIG. 6, illustrating the construction of the chamber.
Figure 8:
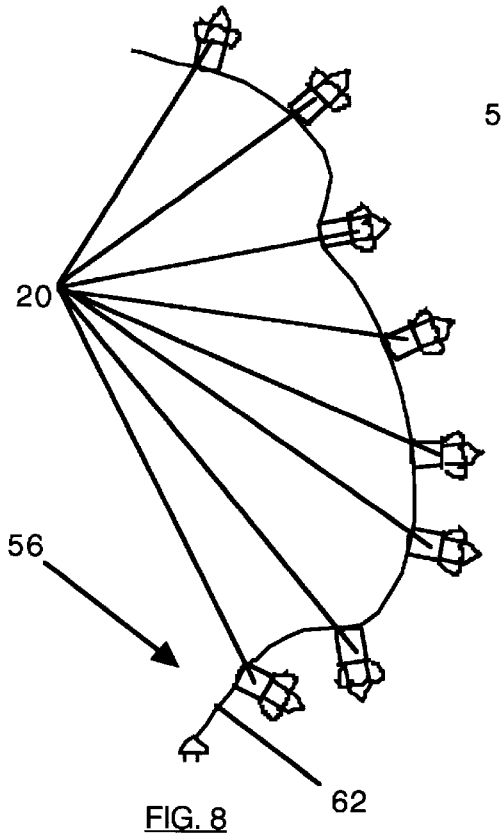
FIG. 8 is a view of the string of ornamental lights employed in connected with the preferred embodiment of the present invention.
Figure 9:
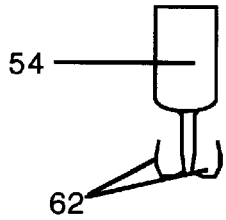
FIG. 9 is a side elevational view of the light socket and wires of an ornamental light employed in connection with the preferred embodiment of the window light assembly of the present invention.
Figure 10:
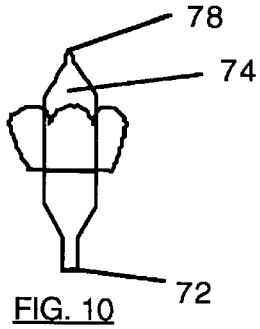
FIG. 10 is a side elevational view of the light bulb of an ornamental light employed in connection with the preferred embodiment of the window light assembly of the present invention.

Referring now to the drawings in detail there is illustrated a window light assembly constructed in accordance with the principles of the present invention.

To illustrate the invention, FIGS. 1–10 and 16–19 show a preferred embodiment illustrating the window light assembly 10. The window light assembly 10 is provided for the purpose of displaying ornamental lights 20 within a window. The window light assembly 10 includes a frame assembly 22 which is substantially rectangular in shape and is dimensioned to fit the opening in a window frame 42. More specifically, the frame assembly 22 includes an elongated rectangular lower member 24 which is positioned opposite an elongated rectangular upper member 26, and two opposed elongated rectangular side members 28.

The upper member 26, lower member 24 and side members 28 are constructed of plastic and are cooperatively engaged proximate their respective member ends 30 forming right angles and defining a rectangular opening 31. The opposed side members 28 of the preferred embodiment have lowers ends 32 which project a distance 34 beyond the lower member 24. The upper member 26, lower member 24, and side members 28 may be integrally formed or independently formed and joined together by any common bonding means 36 (not shown), such as glue, nails, staples, and tongue-in-groove arrangements. Preferably, the frame assembly 22 is constructed of plastic and the bonding means 36 is plastic welding, although it will readily be understood by those skilled in the art that the frame assembly may be of varying sizes, shapes, colors, forms, materials or construction, including, rubber, plastic and other polymers or suitable material.

The outer periphery 38 of the frame assembly is constructed and dimensioned to nest within the inner periphery 40 of a window frame 42 and may be secured thereto by traditional securing means 44 such as nails, tape or latches disposed along the length of the frame assembly 22. The securing means 44 of the preferred embodiment is a single nail 44 driven through the upper member 26 into the top 46 of the window frame 42 and engaging the upper member 26 and the window frame 42. The lower ends 32 of the opposed side members 28 which extend beyond the lower member 24 are dimensioned to rest upon the window sill 48 providing resting support to the frame assembly 22.

Formed within the inner facing surfaces 50 of the upper member 26, lower member 24 and opposed side members 28 at regularly spaced intervals are a plurality of generally cylindrical chambers 52 extending through the entire width of the upper member 26, lower member 24 and opposed side members 28. The chambers 52 are sized to receive therein associated light sockets 54 of a string 56 of conventional ornamental lights 20. Glue 80 secures the sockets 54 within the chambers 52. However, it will readily be understood by those skilled in the art that the chambers 52 may be sized to receive the light sockets 54 in frictional engagement.

Formed within the outer surfaces 58 of the upper member 26, lower member 24 and opposed side members 28 are generally rectangular grooves 60 extending substantially the lengths thereof and being sized and disposed to receive therethrough the light sockets 54 of a string 56 of conventional ornamental lights 22 and to receive and house the wiring 62 for the lights 22.

The grooves 60 of the preferred embodiment are covered with colored tape 64, although it will be readily understood by those skilled in the art that plastic, or other suitable material may be used to conceal the wiring 62.

Figure 11:
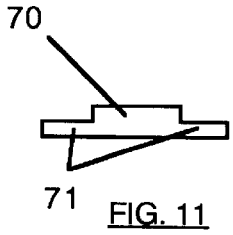
FIG. 11 is a side elevational view of cap employed in connection with the preferred embodiment of the window light assembly of the present invention.
Figure 12:
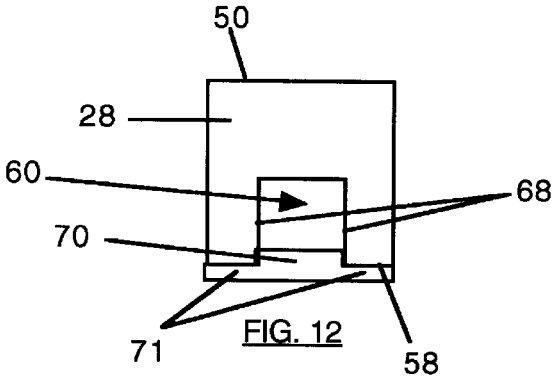
FIG. 12 is side elevational view of a side member of the preferred embodiment of the window light assembly of the present invention, illustrating the side member, a cap and the cooperation therebetween.
Figure 13:
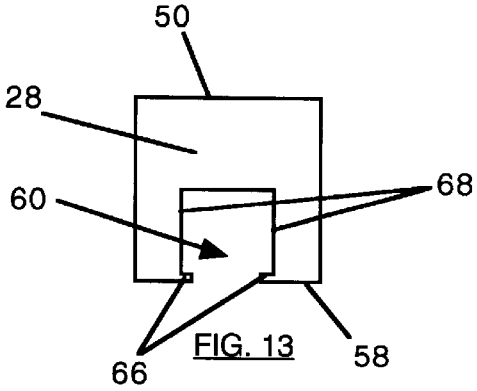
FIG. 13 is side elevational view of a side member of an alternative embodiment of the window light assembly of the present invention, illustrating the flange portions.

In an alternative embodiment as shown in FIGS. 11 & 12, the upper member 26, lower member 24 and side members 28 have flange portions 66 formed along the lengths of the inwardly facing side walls 68 of the grooves 60 and extending laterally towards each other. Elongated preconstructed T-shaped caps 70 having laterally extending legs 71 are engagingly received between the flange portions 66 and disposed proximate the outer surface 58 of the the upper member 26, lower member 24 and side members 28 and extending substantially the length of the grooves 60 to conceal the wiring 62. The laterally extending legs 71 of the T-shaped caps extend the entire width of the upper member 26, lower member 24 a nd side members 28. The caps 70 may be friction fit, glued, taped or otherwise secured in place.

Figure 14:
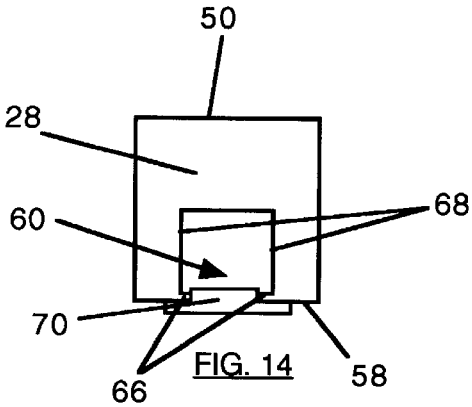
FIG. 14 is side elevational view of a side member of an alternative embodiment of the window light assembly of the present invention, illustrating the flange portions, an alternative cap, and the cooperation therebetween.

In another alternative embodiment as shown in FIG. 14, laterally extending legs 71 of the T-shaped caps do not extend the entire width of the upper member 26, lower member 24 and side members 28.

Figure 15:
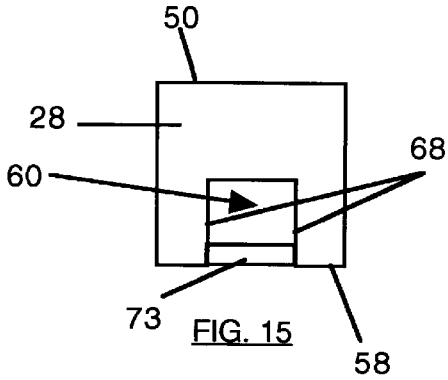
FIG. 15 is side elevational view of a side member of an alternative embodiment of the window light assembly of the present invention, illustrating the flange portions, a plug, and the cooperation therebetween.
Figure 16:
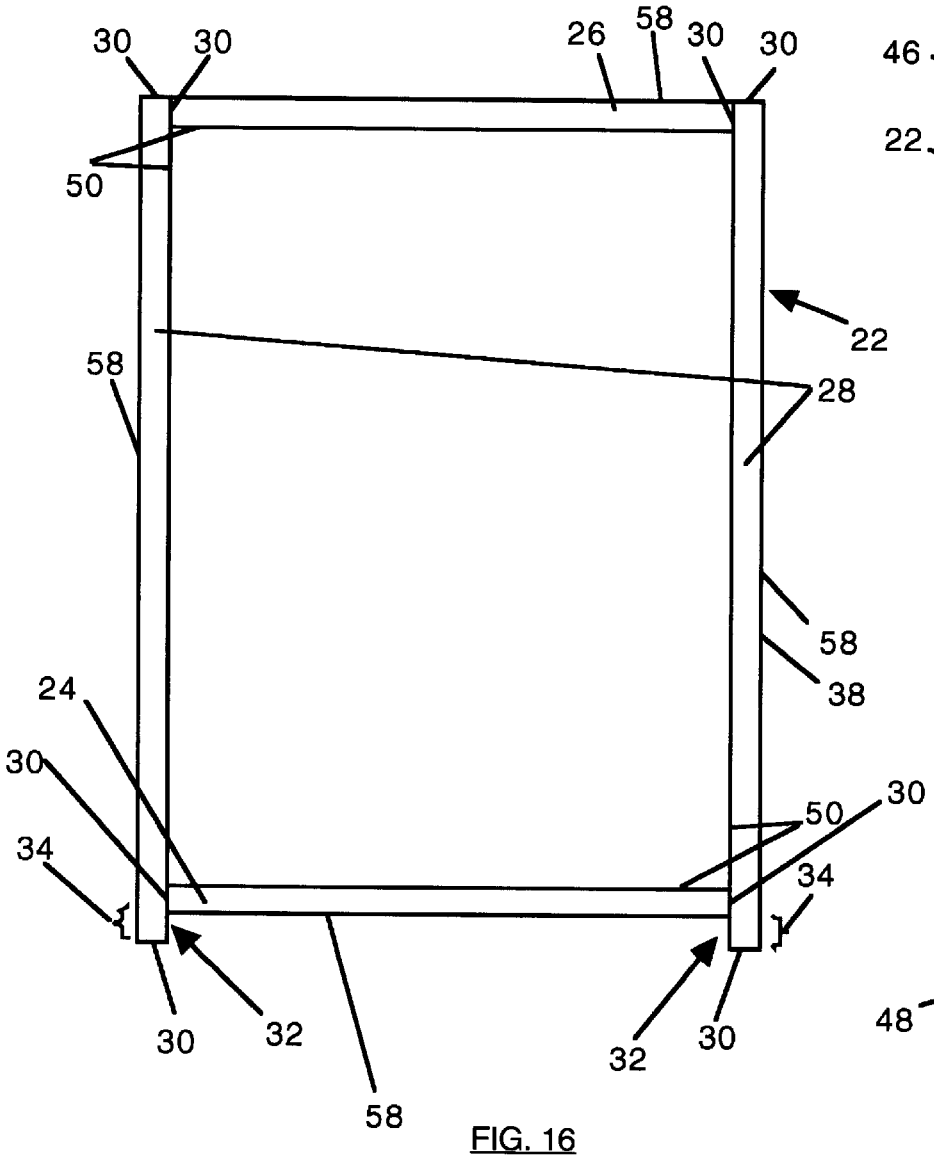
FIG. 16 is a front elevational view of a preferred form of the window light assembly constructed according to the principles of the present invention, illustrating the frame assembly with the lights removed.
Figure 17:
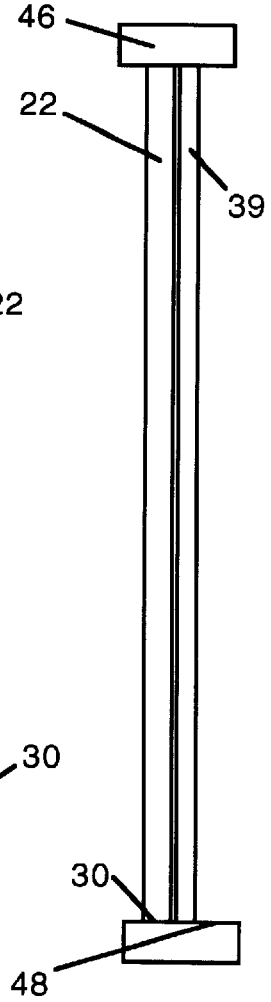
FIG. 17 is a side elevational view of a side member, a window sill and the top of the window frame, illustrating the cooperation thereamong.
Figure 18:
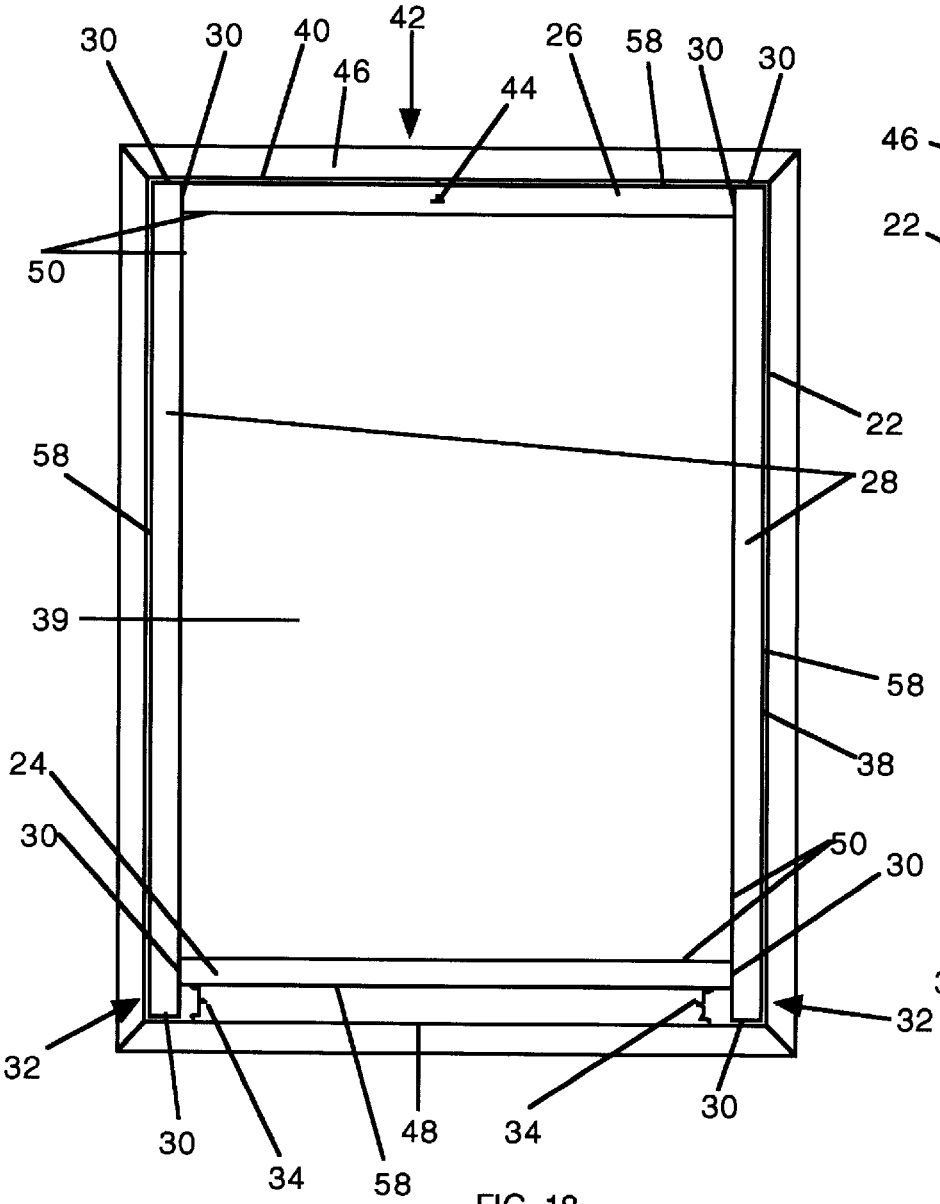
FIG. 18 is a front elevational view of a preferred form of the window light assembly constructed according to the principles of the present invention and a window frame, illustrating the cooperation therebetween.
Figure 19:
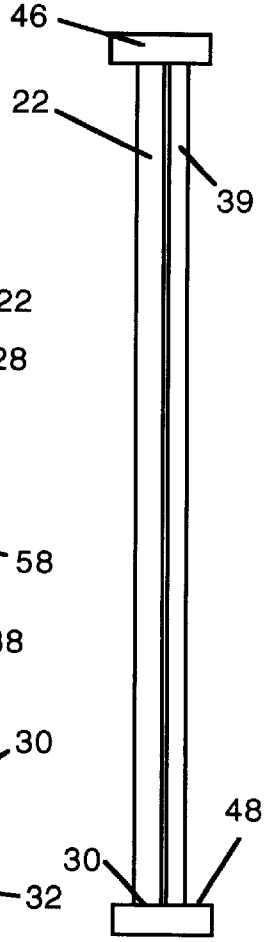
FIG. 19 is a side elevational view of a side member, a window sill and the top of the window frame, illustrating the cooperation thereamong.

In another alternative embodiment shown in FIG. 15, one or more generally rectangular plugs 73 are dimensioned to friction fit within the grooves 60.

Figure 20:
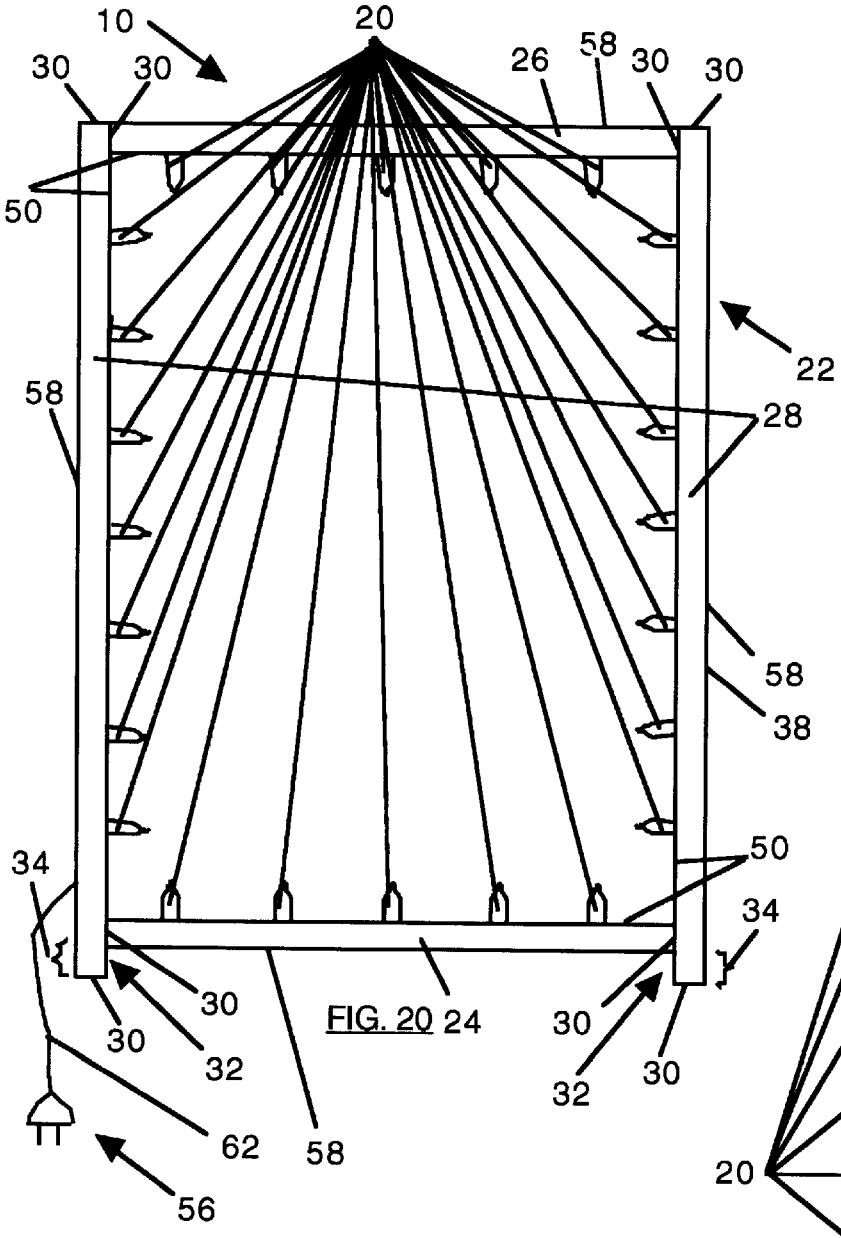
FIG. 20 is a front elevational view of an alternative form of the window light assembly constructed according to the principles of the present invention, illustrating the alternative lights.
Figure 21:
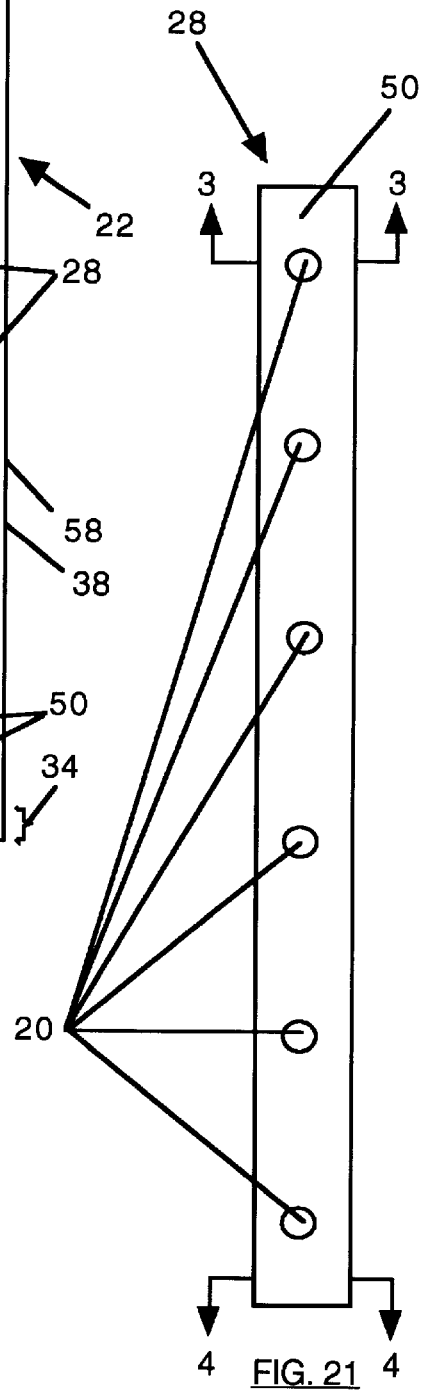
FIG. 21 is a side elevational view of a side member illustrating the spaced arrangement of the ornamental lights along the length of the side member of the alternative embodiment.
Figure 22:
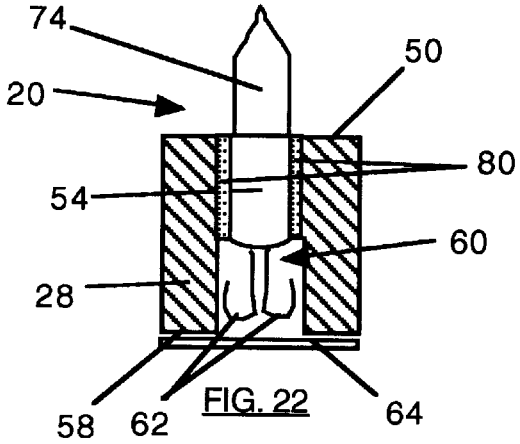
FIG. 22 is a taken along line 22—22 of FIG. 21 illustrating the light, groove, chamber, glue and tape of the alternative form of the window light assembly, and the cooperation thereamong.

In FIGS. 20–22, alternative ornamental lights 20 are illustrated.

In operation, the frame assembly 22 is premeasured, sized and constructed to fit a window. The wiring 62 of a string 56 of conventional ornamental lights 20 is disposed in the grooves 60 with the light sockets 54 being fed into securing engagement within associated chambers 52. The light sockets 54 then receive and seat first ends 72 of associated light bulbs 74 which are fed through the inner facing surfaces 50 of the upper member 26, lower member 24 and opposed side members 28, the opposite ends 78 of the light bulbs 74 projecting laterally inwardly from the frame assembly 22. If used, the tape 64, plastic, caps 70 or other suitable material is disposed along the outer periphery 38 of the frame assembly 22 to conceal the wiring 62. The frame assembly 22 is then nested within the window frame 42 in the interior of a building proximate the window pane 39 and secured, if necessary.

It will readily be understood by those skilled in the art that a variety of additional ornamental or decorative means can be incorporated into the preferred and alternative embodiments without departing from the spirit and scope of the invention.

Likewise, while the invention has been described in connection with a preferred embodiment, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A custom window light assembly for displaying ornamental lights within a window comprising:

a substantially rectangular frame assembly, said frame assembly comprising an elongated generally rectangular lower member, an elongated generally rectangular upper member disposed opposite said elongated rectangular lower member, and two opposed elongated rectangular side members;

said upper member, said lower member and said side members having respective member ends and being cooperatively engaged proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights; and said opposed side members have lower ends which project a distance beyond said lower member, said lower ends being adopted to rest upon the window sill of the window providing resting support to said frame assembly.

2. A method of constructing and displaying ornamental lights, using the custom window light assembly of claim 1, comprising the steps of:

remeasuring, sizing and constructing the custom frame assembly to fit a window;

disposing the wiring of a string of conventional ornamental lights in said grooves with the light sockets being fed into securing engagement within said associated chambers;

receiving and seating first ends of associated light bulbs which are fed through the inner facing surfaces of the upper member, lower member and opposed side members into said sockets, said opposite ends of the light bulbs projecting laterally inwardly from said frame assembly; and nesting the frame assembly within the window frame in the interior of a building proximate the window pane.

3. A method of constructing and displaying ornamental lights, using the custom window light assembly of claim 1, comprising the steps of:

remeasuring, sizing and constructing the custom frame assembly to fit a window;

disposing the wiring of a string of conventional ornamental lights in said grooves with the light sockets being fed into securing engagement within said associated chambers;

receiving and seating first ends of associated light bulbs which are fed through the inner facing surfaces of the upper member, lower member and opposite side members into said sockets, said opposite ends of the light bulbs projecting laterally inwardly from said frame assembly;

nesting the frame assembly within the window frame in the interior of a building proximate the window pane; and driving a nail through said upper member into the top of the window frame and engaging said upper member and the window frame.

4. A custom window light assembly for displaying ornamental lights within a window comprising:

a substantially rectangular frame assembly, said frame assembly comprising an elongated generally rectangular lower member, an elongated generally rectangular upper member disposed opposite said elongated rectangular lower member, and two opposed elongated rectangular side members;

said upper member, said lower member and said side members having respective member ends and being cooperatively engaged proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights; and said grooves are covered with colored tape to conceal the wiring.

5. A custom window light assembly for displaying ornamental lights within a window comprising:

a substantially rectangular frame assembly, said frame assembly comprising an elongated generally rectangular lower member, an elongated generally rectangular upper member disposed opposite said elongated rectangular lower member, and two opposed elongated rectangular side members;

said upper member, said lower member and said side members having respective member ends and being cooperatively engaged proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights; and said frame assembly is secured to the window by a nail driven through said upper member into the top of the window frame and engaging said upper member and the window frame.

6. A custom window light assembly for displaying ornamental lights within a window comprising:

a substantially rectangular frame assembly, said frame assembly comprising an elongated generally rectangular lower member, an elongated generally rectangular upper member disposed opposite said elongated rectangular lower member, and two opposed elongated rectangular side members;

said upper member, said lower member and said side members having respective member ends and being cooperatively engaged proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights; and said upper member, said lower member, and said side members are independently formed and joined together by plastic welding bonding means.

7. A custom window light assembly for displaying ornamental lights within a window comprising:

a substantially rectangular frame assembly, said frame assembly comprising an elongated generally rectangular lower member, an elongated generally rectangular upper member disposed opposite said elongated rectangular lower member, and two opposed elongated rectangular side members;

said upper member, said lower member and said side members having respective member ends and being cooperatively engaged proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights;

said grooves having inwardly facing sidewalls, said upper member, said lower member and said side members having associated flange portions formed along the lengths of said inwardly facing side walls extending laterally towards each other; and elongated T-shaped caps having laterally extending legs, said caps adapted to be engagingly received between said flange portions, said legs disposed proximate the outer surface of said upper member, said lower member and said side members, said caps extending substantially the lengths of said grooves to conceal said wiring.

8. The custom window light of claim 7 wherein said laterally extending legs extend the entire width of said associated upper member, said lower member and said side members.

9. The custom window light assembly of claim 7 wherein said caps are sized to be friction fit between said flanges portions.

10. The custom window light assembly of claim 7 wherein said laterally extending legs of said T-shaped caps do not extend the entire width of said upper member, said lower member and said side members.

11. A custom window light assembly for displaying ornamental lights within a window comprising:

a substantially rectangular plastic frame assembly, said frame assembly comprising an elongated generally rectangular lower member, an elongated generally rectangular upper member disposed opposite said elongated rectangular lower member, and two opposed elongated rectangular side members;

said upper member, said lower member and said side members being independently formed, having respective member ends and being joined together by plastic welding proximate said respective member ends forming generally right angles and defining a generally rectangular opening;

said frame assembly being constructed and dimensioned to define an outer periphery adapted to nest within the inner periphery of a window frame;

said upper member, said lower member and said opposed side members having respective inner facing surfaces defining a plurality of generally cylindrical chambers at regularly spaced intervals, said chambers extending through the entire width of said upper member, said lower member and said opposed side members, said chambers being sized to receive therein associated light sockets of a string of conventional ornamental lights;

said upper member, said lower member and said opposed side members having respective outer surfaces defining grooves extending substantially the lengths thereof and being sized and disposed to receive therethrough the light sockets of a string of conventional ornamental lights and to receive and house the wiring for the lights, said grooves being covered with colored tape to conceal the wiring;

said opposed side members have lower ends which project a distance beyond said lower member;

said lower ends being adopted to rest upon the window sill of the window providing resting support to said frame assembly;

said frame assembly being secured to the window by a nail driven through said upper member into the top of the window frame and engaging said upper member and the window frame;

glue securing the sockets within said chambers;

said grooves having inwardly facing sidewalls, said upper member, said lower member and said side members having associated flange portions formed along the lengths of said inwardly facing side walls extending laterally towards each other; and elongated T-shaped caps having laterally extending legs, said caps adapted to be engagingly received between said flange portions, said legs disposed proximate the outer surface of said upper member, said lower member and said side members, said caps extending substantially the lengths of said grooves to conceal said wiring, said laterally extending legs extending the entire width of said associated upper member, said lower member and said side members, said caps being sized to be friction fit between said flanges portions.

12. A method of constructing and displaying ornamental lights, using the custom window light assembly of claim 11, comprising the steps of:

remeasuring, sizing and constructing the custom frame assembly to fit a window;

disposing the wiring of a string of conventional ornamental lights in said grooves with the light sockets being fed into securing engagement within said associated chambers;

receiving and seating first ends of associated light bulbs which are fed through the inner facing surfaces of the upper member, lower member and opposed side members into said sockets, said opposite ends of the light bulbs projecting laterally inwardly from said frame assembly; and nesting the frame assembly within the window frame in the interior of a building proximate the window pane.

* * * * *